United States Patent [19]

Barber

[11] 4,433,714

[45] Feb. 28, 1984

[54] ROLLER SHUTTER DOORS

[76] Inventor: Arthur B. Barber, 111 Albert St., Strathfield, Sydney, New South Wales, Australia

[21] Appl. No.: 314,110

[22] Filed: Oct. 23, 1981

[51] Int. Cl.[3] ..... E06B 3/12

[52] U.S. Cl. ..... 160/235

[58] Field of Search ..... 160/235

[56] References Cited

U.S. PATENT DOCUMENTS

| | | | |
|---|---|---|---|
| 1,643,074 | 9/1927 | Lavagnino | 160/235 |
| 3,216,102 | 11/1965 | Vecchiarelli | 160/235 |

FOREIGN PATENT DOCUMENTS

| | | | |
|---|---|---|---|
| 695968 | 10/1964 | Canada | 160/235 |
| 400526 | 4/1966 | Switzerland | 160/235 |
| 597995 | 2/1948 | United Kingdom | 160/235 |

*Primary Examiner*—Peter M. Caun
*Assistant Examiner*—Cherney S. Lieberman
*Attorney, Agent, or Firm*—Nelson E. Kimmelman

[57] ABSTRACT

A roller shutter door comprised of a plurality of horizontal panels with interengaged curled longitudinal edges to provide hinge action between the panels. There are strips of resilient material under a compressive load in the hinge joints to substantially eliminate slackness in the hinge joints. The invention also provides a method of assembling such doors, the method involving inserting a strip of resilient material in the curl of a first panel and applying a longitudinal load to the material to cause it to adopt a reduced cross-sectional size followed by the longitudinal insertion of the curl of a second panel into the curl having the stressed material therein and then releasing the load on the material to allow it to urge the curls of the interengaged panels into firm contact one with the other.

5 Claims, 5 Drawing Figures

ROLLER SHUTTER DOORS

This invention relates to doors of the type which act as curtains to openings and which are stored following an opening operation in a vertical direction as a roll on a core which rotates on a horizontal axis. Roller doors and roller shutter doors are the most common forms of the above door type.

Roller doors are commonly formed of a flexible sheet metal panel or several panels rigidly joined to form a full door panel. The door has transverse reinforcing ribs which provide lateral strength without detracting from the flexibility needed in the panel for it to roll around the core. Because the door must flex in order to roll the thickness of the metal has to be maintained within carefully chosen limits. This is also a consideration in the case of panels joined to form a full door panel as the zones adjacent the joints have reduced flexibility because of the several thicknesses of metal involved in the joints.

The ends of the door panel, the vertical edges of the panel, run in channel guides with minimum clearances to limit buckling of the door panel when a lifting effort is applied to the bottom edge of the door in a door opening operation. Nevertheless the door panel can buckle to some extent and the degree of buckling is directly related to the effort required to raise the door. Such doors have a minimum diameter core about which they can be conveniently rolled. These then are the problems with roller doors.

Another form of roller door in the market place is one which has a sandwich section comprising an outer flat sheet metal skin, a like inner skin and an intermediate layer of flexible material. Doors so constructed have the disadvantages of the above described roller doors but in addition are in many cases unable to roll on a core as small as that for use with the first described roller door.

Overhead space saving considerations in home unit and like garages has reached the point where a standard roller door when rolled up cannot be accommodated above the head of the doorway and some of the rolled up door protrudes into the door opening thereby reducing the available headroom. Accordingly there is a need for a roll up type of door which can roll onto a smaller core than that required for a conventional roller door as described above. A roller shutter door, as distinct from a roller door, can roll onto a small diameter core for reasons that will now be explained, but roller shutter doors as now known have disadvantages.

A roller shutter door is one which comprises a plurality of slats with curled longitudinal edges so shaped as to permit slats to be edge connected in a hinging manner. Such doors can be made very strong, from heavy gauge metal, because the ability to roll up onto a core is not related to the flexibility of the material from which it is made. The hinge connections can be arranged to permit the door to be rolled onto a core as little as half the diameter of the core of a roller door. This door form is thus very attractive for low headroom installations. The drawbacks of this form of door are as follows. Because of the need to have working clearance between the interengaging curled edges a rattle can be set up when the door is being raised or lowered. It can also occur when the door is closed and flexed by a gusting wind. The working clearance of the hinge connections permits the door to buckle and to bear on the walls of the channel tracks guiding the ends of the door if a door opening effort is applied to the bottom of a closed door. This makes the opening of the door in this manner heavy work and impractical. For this reason roller shutter doors have been opened in the past by means of a rope or chain wrapped around a pulley fixed to the shaft supporting the core. The raising effort thus results in a tension lifting force in the door panel rather than a compressive force. Some attempts have been made to overcome the buckling problem by making the clearances between the sides of the guide channels and the slats less, such efforts have not been very successful for whilst buckling was decreased the effort to raise the door increased dramatically.

Another problem inherent in roller shutter doors is that some means must be provided to prevent longitudinal relative movement between engaged slats. This problem has exercised the minds of many inventors and a number of patents have been obtained for such means, Australian Patent Nos. 245513 and 411669 are representative.

This invention overcomes in a simple and efficient manner the problems which have made unattractive the use of roller shutter doors in areas where rattling is offensive and where lift opening of the door is desirable. As a further advantage of the invention the complicated methods adopted by others to prevent free longitudinal relative movement between the slats of a roller shutter door are no longer required.

The invention provides a form of roller shutter door and methods of assembly which can be broadly defined as follows.

A shutter comprising a plurality of elongated breadthwise extending slats each with a front face and a back face, each slat having an open edge curl on each of its long edges, one curl of each slat being a forward curl directed towards the front face of the slat and the other curl being a rearward curl directed towards the back face of the slat, the curls being so shaped and dimensioned as to enable a forward curl of one slat to co-act with the rearward curl of an adjacent slat to provide a hinged connection between the two joined slats enabling limited relative angular movement between the joined slats, and strips of compressed resilient material extending the breadth of the shutter and located in each of said hinged connections between adjacent inner surfaces of the co-acting curls thereof.

A method of assembling elongated slats to form a shutter, said method comprising the steps of providing a plurality of elongated slats each with a front face and a back face and an open edge curl along both long edges of each slat with one curl being a forward curl directed towards the front slat face and the other being a rearward curl directed towards the back face of the slat, the curls being so shaped and dimensioned as to enable a forward curl of one slat to co-act with the rearward curl of an adjacent slat to provide a hinged connection between the two adjacent slats enabling limited angular movement between the inter-connected slats, inserting a length of resilient material in the curl of one slat, applying a longitudinal force to the length of resilient material to cause its cross-sectional dimension to be reduced, inserting the curl of the adjacent slat into the curl of the slat in which the length of resilient material is housed and so that the length of resilient material lies between inner surfaces of the interengaged curls of the slats, releasing the longitudinal force from the length of resilient material allowing it to recover to cross-sectional shape and size determined by the space between the inner surfaces of the interconnected curls.

The invention will now be described with reference to the accompanying drawings in which.

Figure 1:
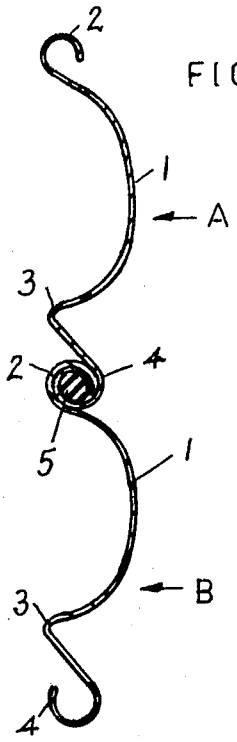
FIG. 1 illustrates a sectional end view of two interengaged slats of a plurality of like slats assembled to make a roller shutter according to the invention.

There is illustrated in FIG. 1 an interconnection between two slats A and B of conventional form each comprising a convex central frontal portion 1 which blends into an open curl 2 at one end directed to the front face of the slat. At the other end the portion 1 blends into a frontal valley 3 which in turn blends into an open curl 4 directed to the rear face of the slat.

The shape and size of the curl 2 is such that it can rotate within the curl 4 within which it is housed thereby allowing a limited amount of relative angular movement between the interconnected slats.

There is a strip of resilient material 5 located under compression between the inner faces of the interconnected curls 2 and 4. The slats are preferably made of metal, but may be moulded from plastics material. The profile of the slat in cross-section can vary but that shown provides good resistance to bending. The curls must be compatible but may vary from the shape illustrated. The strip 5 is preferably made of rubber of circular cross-section and is highly elastic. The diameter of the strip 5 is greater than the spacing between the inner faces of the two interconnected curls.

The curls may be of two different forms, one form permits only one method of assembly of two slats one with the other and the other form permits the assembly technique of the first form and another mode of assembly.

Figure 2:
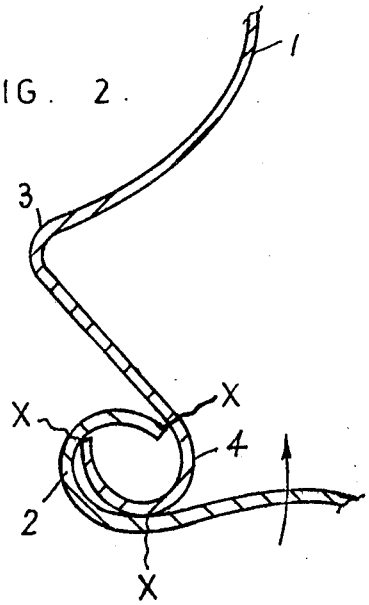
FIG. 2 shows an enlarged view of the engaged curled edges of the slats illustrated in FIG. 1.

The first form of the curls is shown in FIG. 2 wherein it will be seen that the shape of the curls prevents a "roll over" disengagement of the curl of slat A from that of Slat B in the direction of the arrow shown due to contact at least at two of the points X. With curls of the illustrated form longitudinal relative sliding engagement of the curls is necessary to achieve interconnection of the two slats. The shape of the curls is such however as to allow an angular relationship between the slats sufficient to permit a shutter made from a plurality of slats to roll around a core of small diameter compared to that of a core required to roll up a roller door as hereinbefore described.

Figure 3:
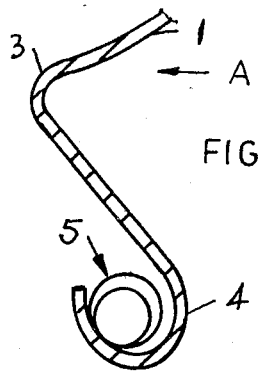
FIG. 3 shows an enlarged view of one curled edge of a slat in which there is housed a length of resilient material.
Figure 6:
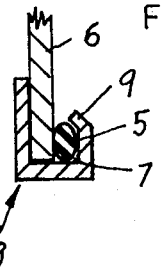

One method of assembling slats with a resilient strip 5 is as follows. The strip 5 is located in the curl 4 of slat A as shown in FIG. 3. A tensile force is applied to the strip 5 to cause it to become smaller in cross-section and become smaller in diameter as illustrated. The crescent between the two circles represents the reduction in cross-sectional area as a result of the tensile force.

Figure 4:
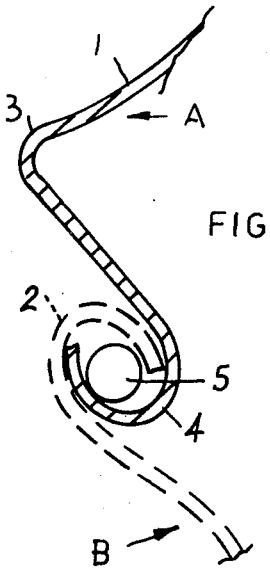
FIG. 4 shows a curled edge of another slat being inserted into the FIG. 3 arrangement.
Figure 7:
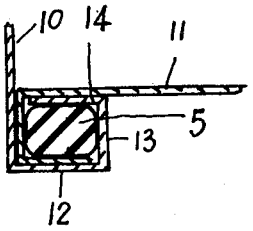

The curl 2 of the slat B is then inserted into the curl of slat A in a longitudinal sliding action, as will be seen from FIG. 4 this action is unhindered by the stretched strip 5. When aligned endways with the slat A the tensile force on the strip 5 is released and it expands to take up the space between the inner faces of the interengaged curls. As will be seen from FIG. 1 the strip 5 takes up a shape determined by the shape of the opening between the inner faces of the curls, which is not perfectly circular.

Figure 5:
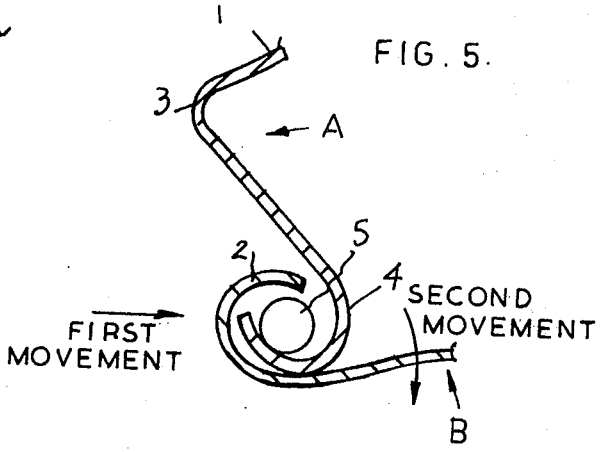
FIG. 5 illustrates the curls of two slats and a method of interconnecting them.

In the other method of assembly the introductory steps are the same, inserting the strip 5 and applying a tensile force. The method of inserting the curl 2 into the curl 4 is as shown in FIG. 5. It involves a hook-in roll-over action followed by the relaxation of the tensile force on the strip 5. For this method the curls are of slightly different shape to those used in the first method. Whilst the curl shape for the second method allows the hook-in roll-over connection it also permits the sliding interengagement of the first method.

The advantages flowing from the use of the strip 5 and its compressed state are several in number. First, the slats are restrained from free endways relative motion. In the past many attempts have been made to prevent such motion without interfering with the operation of the shutter, one such patent is 245513. Second, the rattling which previously occurred in roller shutter doors is eliminated. Third, buckling of the shutter when lifted from below, which made this form of shutter door impractical in many locations, is substantially eliminated.

It is to be noted that disengagement of the curls of the type used in the second method is not possible when the shutter is in service as the guides in which the ends of the slats are housed prevent the slats from adopting the necessary angular relationship. When in a non-operative condition, i.e., still on the assembly bench the shutter lies flat preventing disengagement and if the slats do adopt an angular relationship during handling which approaches that required for disengagement the expanded but compressed strip 5 restricts further angular movement and disengagement.

The shutter is made operational by mounting runner blocks, preferably made of plastic, on the ends of the slats, which blocks travel in the guides located one on either side of the opening to be closed off by the shutter.

The strip 5 need not be circular, in some applications the shape could be rectangular, square or even oval. Likewise, several lengths of elastic material can be inserted in each joint if desired whilst still retaining the advantages set forth hereinbefore. The sizes of strip cross-sections can be different and in the method of installation only one strip need be stretched, although more can be stretched if desired.

I claim:

1. A method of assembling elongated slats to form a shutter, said method comprising the steps of providing a plurality of elongated slats each with a front face and a back face and an open edge curl along both long edges of each slat with one curl directed towards the front slat face and the other being a rearward curl directed towards the back face of the slat, the curls being complementarily shaped to co-act with respective ones of the curls of adjacent interengaged slats, providing a length of resilient material larger in normal cross-section than the area defined by the inner surfaces of the curls of two interengaged curls, inserting the entire length of said resilient material in the curl of a first slat, applying a longitudinal force to the length of resilient material to cause its cross-sectional dimension throughout its length to be uniformly reduced to less than the cross-sectional area defined by the inner surfaces of the curls of two interengaged slats, inserting a complementary curl of a second slat into the curl of the first slat in which the length of resilient material is disposed with the length of resilient material between the inner surfaces of the interengaged curls of the slats, and releasing the longitudinal force from the length of resilient material allowing it to recover to a cross-sectional shape and size determined by the space between the inner surfaces of the interconnected curls.

2. A method as claimed in claim 1 wherein the insertion of said complementary curls is accomplished by longitudinal sliding engagement of one curl in the other.

3. A method as claimed in claim 1 wherein the curls of two adjacent slats are interconnected by aligning two slats side by side with the forward curl of one slat adjacent the rearward curl of the other slat and by relative lateral movement between the slats engaging the curls.

4. A method as claimed in claim 1 wherein the insertion of said complementary curls is accomplished by a hook-in, roll-over motion of said complementary curls into the associated curls of the adjacent slats.

5. A method as claimed in claim 1 wherein said resilient member is solid.

* * * * *

UNITED STATES PATENT OFFICE

CERTIFICATE OF CORRECTION

Patent No. 4,433,714 Dated February 28, 1984

Inventor(s) Arthur B. Barber

It is certified that error appears in the above-identified patent and that said Letters Patent are hereby corrected as shown below:

On the front page of the patent, after the filing data, please insert the following:

--[30] Foreign Application Priority Data
Oct. 23, 1980 [AU] Australia.....PE6184--

Signed and Sealed this

*Twelfth* Day of *February 1985*

[SEAL]

*Attest:*

DONALD J. QUIGG

*Attesting Officer* *Acting Commissioner of Patents and Trademarks*